US007276846B2

(12) United States Patent
Sakaue et al.

(10) Patent No.: US 7,276,846 B2
(45) Date of Patent: Oct. 2, 2007

(54) ENERGY CONVERTER AND LIGHT SOURCE

(75) Inventors: Mika Sakaue, Hirakata (JP); Makoto Horiuchi, Sakurai (JP); Mitsuhiko Kimoto, Nara (JP); Kazuaki Ohkubo, Takatsuki (JP); Yuriko Kaneko, Nara (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 11/251,944

(22) Filed: Oct. 17, 2005

(65) Prior Publication Data

US 2006/0071582 A1 Apr. 6, 2006

Related U.S. Application Data

(63) Continuation of application No. PCT/JP2005/004635, filed on Mar. 16, 2005.

(30) Foreign Application Priority Data

Mar. 30, 2004 (JP) ..... 2004-100899

(51) Int. Cl.
*H01J 5/16* (2006.01)
*H01K 1/00* (2006.01)

(52) U.S. Cl. ..... 313/343; 313/578; 313/633; 313/316

(58) Field of Classification Search ..... 313/112
See application file for complete search history.

(56) References Cited

U.S. PATENT DOCUMENTS

| | | | | |
|---|---|---|---|---|
| 3,875,443 | A * | 4/1975 | Nakamura | 313/274 |
| 5,079,473 | A | 1/1992 | Waymouth | |
| 5,753,381 | A * | 5/1998 | Feldman et al. | 428/696 |
| 7,049,735 | B2 * | 5/2006 | Ohkubo et al. | 313/341 |

FOREIGN PATENT DOCUMENTS

| | | |
|---|---|---|
| JP | 05-251059 | 9/1993 |
| JP | 05-258730 | 10/1993 |
| JP | 06-013055 | 1/1994 |
| WO | 03/058676 A2 | 7/2003 |

OTHER PUBLICATIONS

International Search Report for corresponding Application No. PCT/JP2004/004635 mailed Jul. 5, 2005.
Japanese Office Action for Japanese Application No. 2006-515320 dated Jun. 27, 2006 and English Translation.

* cited by examiner

*Primary Examiner*—Ashok Patel
(74) *Attorney, Agent, or Firm*—Renner, Otto, Boisselle & Sklar, LLP

(57) ABSTRACT

An energy converter according to the present invention includes a filament 11 for converting given energy into electromagnetic waves and radiating the waves, and a radiation suppressing portion for suppressing some of the electromagnetic waves (e.g., infrared rays), which have been radiated from the filament 11 and of which the wavelengths exceed a predetermined value. The radiation suppressing portion has a bundle 12 of fine wires 12*a*, of which the axial direction is aligned with a direction in which the electromagnetic waves propagate with their radiations suppressed.

10 Claims, 12 Drawing Sheets

ENERGY CONVERTER AND LIGHT SOURCE

This is a continuation of International Application PCT/JP2005/004635, with an international filing date of Mar. 16, 2005.

BACKGROUND OF THE INVENTION

1. Field of the Invention

The present invention relates to an energy converter for converting energy into radiation of electromagnetic waves and also relates to a light source with such an energy converter.

2. Description of the Related Art

One of major obstacles that prevent an artificial light source from achieving high luminous efficacy is that the light source cannot convert energy into visible radiation without radiating a lot of infrared rays, of which the wavelengths are too long to sense with human eyes, at the expense of the visible radiation.

An incandescent lamp, used extensively today as a common illumination source, includes a filament functioning as a thermal radiator. The "thermal radiator" is a radiation source that emits an electromagnetic wave by thermal radiation. And the "thermal radiation" means radiation (of an electromagnetic wave) produced by applying heat energy to atoms or molecules of an object. The thermal radiation energy is determined by the temperature of the object and has a continuous spectrum. In the following description, the thermal radiator will be simply referred to herein as a "radiator".

An incandescent lamp needs no ballasts, has a small size and a light weight, and shows a higher color rendering index than any other artificial light source. Due to these advantageous features, the incandescent lamp is a light source that is used most broadly worldwide.

To increase the radiation efficiency of incandescent lamps, people tried to raise the operating temperature of the radiator or to find a radiator that has a small radiation in the infrared range. History teaches us that a carbon filament as a radiator material for an incandescent lamp was replaced by the currently used tungsten filament as a result of those efforts. By using the radiator of tungsten, the radiator could operate at a higher temperature than the radiator of any other material and therefore could reduce the percentage of radiations in the infrared range.

However, in spite of their efforts, the radiation produced by current incandescent lamps, using the tungsten filament, in the visible wavelength range is just 10% of the overall radiations thereof. The majority of the other radiations are infrared radiations, which account for as much as 70% of the overall radiations. Also, the current incandescent lamps cause heat conduction due to an enclosed gap or a heat loss of 20% due to convection and have a luminous efficacy of about 15 lm/W, which is among the lowest ones in various artificial light sources. This performance of the incandescent lamps has not been improved significantly since 1930's.

Meanwhile, Japanese Patent Application Laid-Open Publication No. 03-102701 and other documents disclose a technique of drastically reducing the infrared radiations produced by a radiator and increasing the luminous efficacy of the lamp significantly. According to this technique, an array of very small cavities functioning as waveguides (which are termed "micro-cavities") is provided on the surface of the radiator, thereby suppressing radiations of which the wavelengths exceed a predetermined value (e.g., infrared radiations) and selectively emitting only electromagnetic radiations with the predetermined wavelength. This patent document describes that cavities with a width of about 350 nm and a depth of about 7 μm are arranged at an interval of about 150 nm, thereby suppressing infrared radiations of which the wavelengths exceed about 700 nm. This patent document also describes that the luminous efficacy increases as much as six-fold at an operating temperature of 2,000 K to 2,100 K.

However, the micro-cavities disclosed in this patent document are tiny holes, of which the bottom is of a nanometer scale. Thus, it is not easy to make an array of such tiny micro-cavities on the surface of a filament.

Also, it was discovered that even when an array of micro-cavities with an inside diameter as small as 1 μm or less could be made on the surface of a filament made of tungsten or any other refractory material, those cavities collapsed during the operation. The present inventors discovered via experiments that such collapse occurred within a few minutes at 1,200 K, which is lower than the melting point of tungsten (of 3,650 K). Although Patent Document No. 1 is silent about the collapse of micro-cavities occurring at such a low temperature, this collapse would constitute a big obstacle to actually using a filament with those micro-cavities.

In order to overcome the problems described above, an object of the present invention is to provide an energy converter, of which the radiation suppressing portion for suppressing electromagnetic radiations with wavelengths exceeding a predetermined value has a sufficiently long life that has been extended so much as to use it actually, and also provide a light source including such an energy converter.

SUMMARY OF THE INVENTION

An energy converter according to the present invention includes a radiator for converting given energy into electromagnetic waves and radiating the waves and a radiation suppressing portion for suppressing some of the electromagnetic waves, which have been radiated from the radiator and of which the wavelengths exceed a predetermined value. The radiation suppressing portion has a bundle of fine wires, of which the axial direction is aligned with a direction in which the electromagnetic waves propagate with their radiations suppressed.

In one preferred embodiment, a space of 1 μm or less is provided between the radiator and the radiation suppressing portion.

In another preferred embodiment, the given energy is heat.

In still another preferred embodiment, each of the fine wires is in contact with its adjacent fine wires and a gap created between the fine wires functions as a micro-cavity.

In yet another preferred embodiment, the radiator receives Joule heat as the energy.

In yet another preferred embodiment, the fine wires are made of a refractory material with a melting point higher than 2,000 K.

In a specific preferred embodiment, the refractory material is selected from the group consisting of tungsten, molybdenum, rhenium, tantalum, and alloys thereof.

In yet another preferred embodiment, the fine wires are polycrystalline and have crystal grains that are aligned in the axial direction.

In yet another preferred embodiment, the radiator is made of either tungsten or an alloy thereof.

A light source according to the present invention includes: an energy converter according to any of the preferred embodiments described above; a housing for shielding the energy converter from the air, at least a portion of the housing being translucent; and a terminal for supplying electrical energy to the radiator included in the energy converter. The radiation suppressing portion suppresses radiations of infrared rays.

In one preferred embodiment, the fine wires have a substantially circular transversal cross section with a diameter of 400 nm to 2.5 μm.

A method of making an energy converter according to the present invention includes the steps of: preparing a radiator for converting given energy into electromagnetic waves and radiating the waves; preparing a radiation suppressing portion for suppressing some of the electromagnetic waves, which have been radiated from the radiator and of which the wavelengths exceed a predetermined value; and arranging the radiation suppressing portion near the radiator. The step of preparing the radiation suppressing portion includes preparing a plurality of fine wires and making a bundle of the fine wires so that adjacent ones of the wires contact with each other.

In one preferred embodiment, the step of preparing the radiation suppressing portion includes cutting the bundle of the fine wires.

According to the present invention, a radiation suppressing portion for suppressing some of electromagnetic waves, which have been radiated from a radiator and of which the wavelengths exceed a predetermined value, is provided as a bundle of fine wires. The gaps created between those fine wires are so small as to function as micro-cavities with cutoff frequencies that are changeable according to the size. Also, even though their gaps are very small, the fine wires are thermally stabilized and can have a long life even at high temperatures. Thus, the energy converter of the present invention can operate for a long time with good stability even at high temperatures, and can convert given energy into electromagnetic radiations in a predetermined wavelength range efficiently, thus contributing to saving a lot of energy and preserving the global environment.

DETAILED DESCRIPTION OF PREFERRED EMBODIMENTS

Figure 1A:
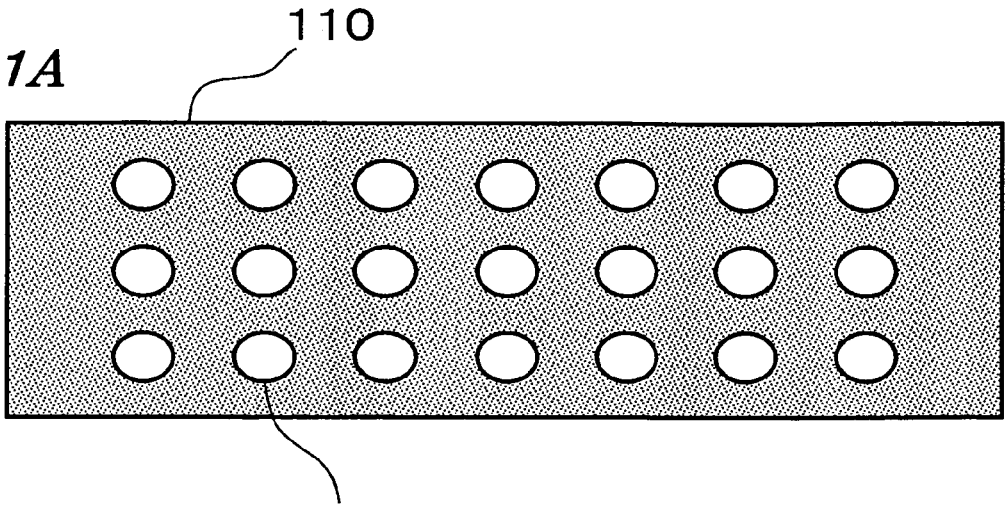
FIG. 1A is a top view of a conventional tungsten filament on which an array of micro-cavities is provided.

First, it will be described with reference to FIGS. 1A through 1C why when an array of cavities, of which the size is comparable to the wavelengths of visible radiations, is made on the surface of a tungsten filament used in conventional incandescent lamps, those cavities will collapse at an operating temperature that is much lower than the melting point of tungsten. FIG. 1A is a plan view of a conventional tungsten filament on which an array of micro-cavities is made, and FIG. 1B is a cross-sectional view thereof.

Figure 1B:
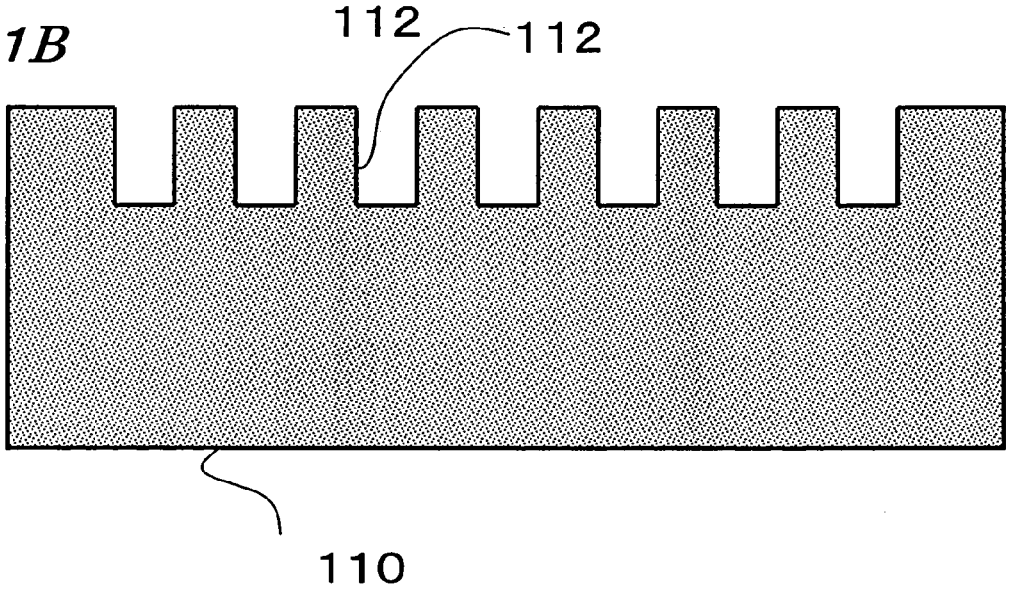
FIG. 1B is a cross-sectional view thereof.
Figure 1C:
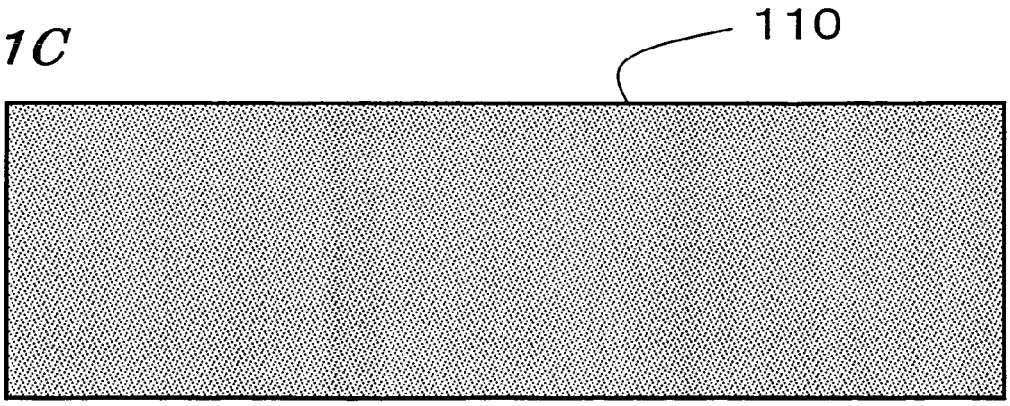
FIG. 1C is a cross-sectional view showing the tungsten filament on which the micro-cavities have already collapsed.

On the surface of the tungsten filament 110 shown in FIGS. 1A and 1B, made is an array of micro-cavities 112. Each of those micro-cavities 112 has an inside diameter of 750 nm and a depth of 7 μm, for example. It is believed that those micro-cavities collapse mainly because of the migration of tungsten atoms. More specifically, the actual lattice structure of tungsten has a lot of lattice defects (i.e., the arrangement of atoms is out of order at a lot of sites). Due to these lattice defects, the atoms and crystal grains have discontinuous and irregular arrangements. Even if thermal energy that is high enough to vaporize those atoms or crystals actively is not applied, parts of such a microstructure including crystalline defects are constantly on the move (i.e., diffusing or migrating) so as to have its structure stabilized. For example, the grain boundary functions as a sort of hinge so to speak, thereby making the crystal grains flow.

Owing to such a phenomenon, when the surface of a metal with very small unevenness is heated to a high temperature, the atoms will flow to collapse and flatten the very small unevenness on the metal surface just as the surface of a liquid smoothes down. FIG. 1C shows how the unevenness on the surface of the tungsten filament 110 has been smoothed out due to the migration of atoms at a high temperature. The present inventors discovered and confirmed via experiments that the micro-cavities 112, which had been present on the surface of the tungsten filament 110, easily collapsed and had their surface smoothed out even at an unexpectedly low temperature (e.g., at a temperature at which tungsten usually hardly vaporizes).

Particularly when the size of the micro-cavities 112 is approximately equal to the wavelengths of visible radiation (on the order of nanometers), the surface of tungsten flattens easily. This could be because those cavities themselves, of which the size is comparable to the wavelength of visible radiation, may function as tiny uneven structures that are as small as lattice defects.

For these reasons, even if very small micro-cavities are formed on the surface of a conventional filament made of tungsten, for example, a practically long life cannot be guaranteed at a normal operating temperature.

Figure 2A:
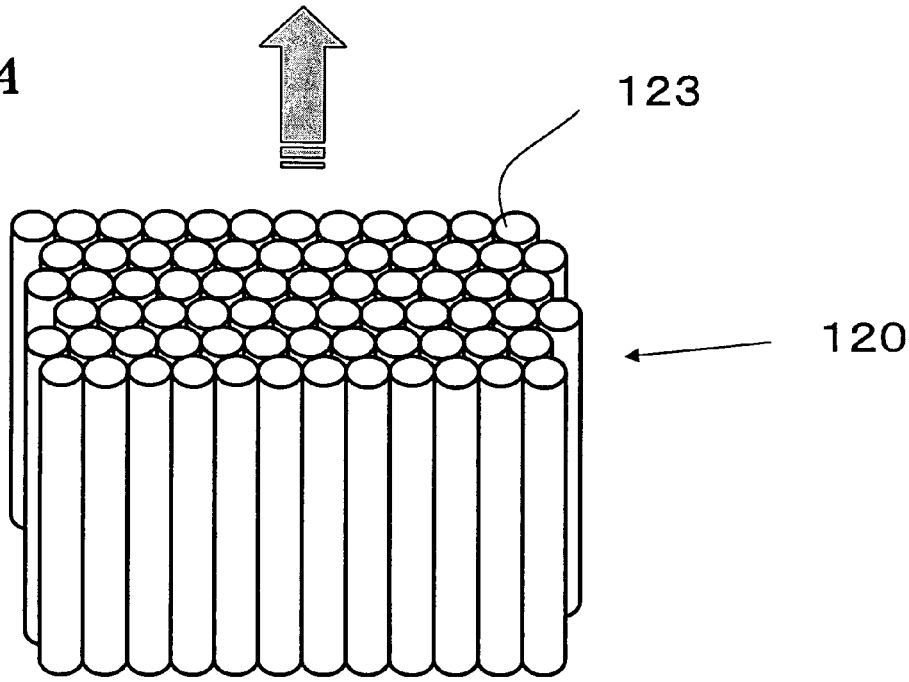
FIG. 2A is a partially enlarged perspective view illustrating an exemplary radiation suppressing portion for an energy converter according to the present invention.
Figure 2B:
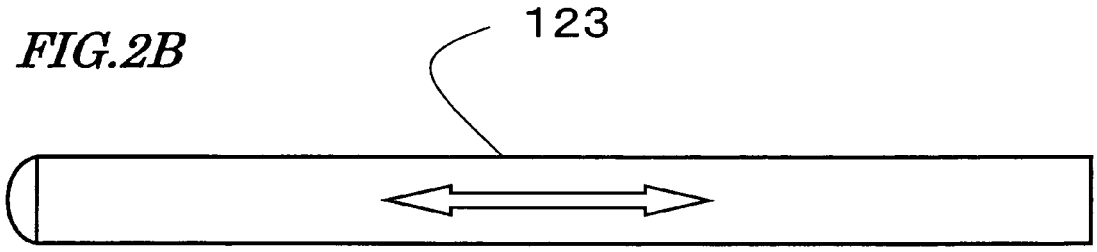
FIG. 2B is a schematic representation showing a direction in which crystal grains of a metal fine wire 123 are aligned.

Next, a radiation suppressing portion for use in the present invention will be described with reference to FIGS. 2A and 2B. FIG. 2A illustrates an exemplary bundle 120 of fine wires 123 functioning as a radiation suppressing portion according to the present invention. FIG. 2B schematically shows the overall alignment direction of metallic crystal grains included in each of those fine wires 123.

The present inventors discovered via experiments that in the bundle 120 of fine wires 123 made of a refractory metal, even if there were lattice defects in those fine wires 123, the bundle 120 of those fine wires 123 hardly collapsed even at an elevated temperature exceeding 2,000 K. This is believed to be because even when the atoms or crystal grains, forming the fine wires 123, are supplied with high thermal energy and migrating at such a high temperature, the overall migration direction will be substantially parallel to the axial direction (i.e., the length direction) of the fine wires 123. For that reason, the structure in which the fine wires 123 are bundled together so as to create a lot of gaps functioning as micro-cavities is highly stabilized thermally. In contrast, as the sizes of very small unevenness or very small holes decrease on the surface of a metal or on metal foil, that unevenness or those holes will collapse under the heat more and more easily.

The high thermal stability as found in the bundle 120 of fine wires 123 for use in the present invention should be further increased by the crystal structure of the fine wires 123. That is to say, the fine wires 123 are usually made by stretching a metallic material uniaxially by taking advantage of its ductility. When the metal is stretched in this manner, the crystal grains will grow and be aligned in the directions pointed by the arrow in FIG. 2B. As a result, the thermal stability of the fine wires 123 would be further increased.

According to the present invention, the radiation efficiency of a radiator that radiates electromagnetic rays is increased within a particular wavelength range by using the bundle 120 of fine wires 123 such as that shown in FIG. 2A. Consequently, a high-efficiency energy converter that has a sufficiently long life in practice even at a high temperature can be obtained.

Hereinafter, preferred embodiments of the present invention will be described with reference to the accompanying drawings. It should be noted that the present invention is in no way limited to the following illustrative preferred embodiments.

Embodiment 1

First, a preferred embodiment of a light source, including a light-emitting portion 10 functioning as an energy converter according to the present invention, will be described with reference to FIG. 3. The light source of this preferred embodiment is an incandescent lamp.

Figure 3:
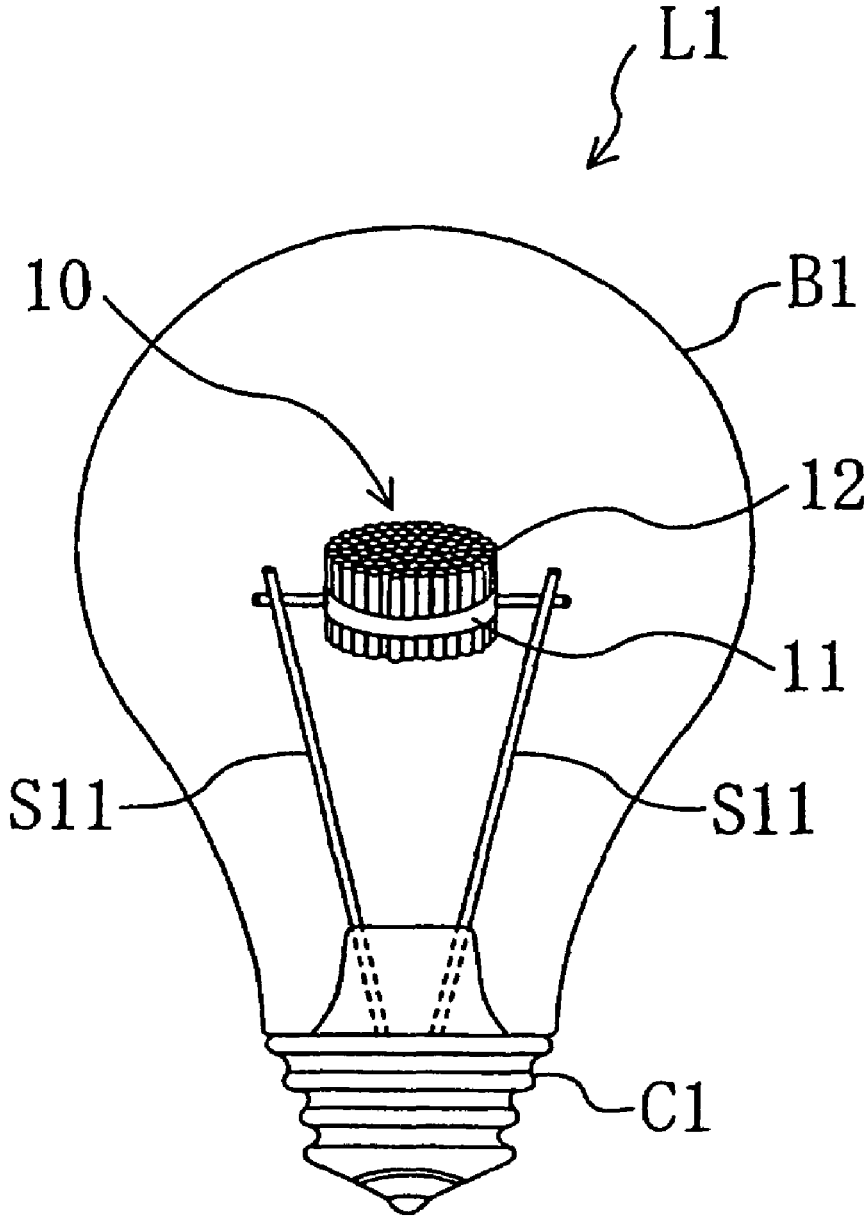
FIG. 3 is a schematic representation of an incandescent lamp L1 according to a first preferred embodiment of the present invention.

The incandescent lamp L1 shown in FIG. 3 includes the light-emitting portion 10 including a filament 11 that generates heat when supplied with electrical power, a substantially spherical translucent bulb B1 that houses the light-emitting portion 10, a pair of stems S11 that supports the filament 11 thereon, and a cap C1 for supplying electrical power to the filament 11 through the pair of stems S11. A rare gas and nitrogen gas (not shown) are enclosed in the bulb B1.

Figure 4:
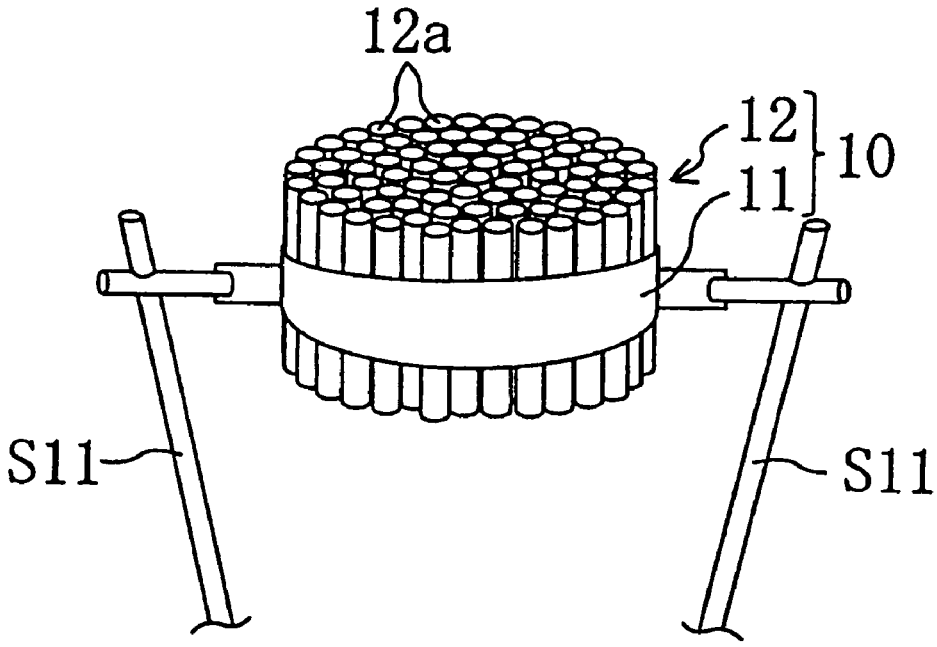
FIG. 4 is a perspective view illustrating a light-emitting portion 10 according to the first preferred embodiment.

As shown in detail in FIG. 4, the light-emitting portion 10 includes a bundle of fine wires 12*a* (which will be referred to herein as a "bundle 12") and a ringlike or cylindrical filament 11 that contacts with the side surface of the bundle 12 and supports the bundle 12 thereon.

The filament 11 functions as a radiator for converting given thermal energy into electromagnetic waves and radiating the waves. On the other hand, the bundle 12 functions as a radiation suppressing portion for suppressing some of the electromagnetic waves, which have been radiated from the radiator and of which the wavelengths exceed a predetermined value. The axial direction of the fine wires 12*a* is aligned with the direction in which the electromagnetic waves propagate with their radiation suppressed. The radiation can be suppressed because the gaps created between the fine wires 12*a* function as micro-cavities. It is determined by the sizes of the gaps (or micro-cavities) in the bundle 12 in what wavelength range the electromagnetic waves need to be suppressed.

Current is supplied to the ringlike filament 11 through the pair of stems S11. When current flows through the filament 11, the filament 11 generates Joule heat and has its temperature raised to about 2,000 K, thereby radiating electromagnetic waves. The filament 11 of this preferred embodiment is made of tungsten, which is one of refractory metals.

The current supplied from the cap C1 passes one of the two stems S11, flows along the filament 11 toward the other stem S11, and then goes back to the cap C1 by way of the other stem S11.

Since the ringlike filament 11 is loaded with the fine wires 12*a*, some of the electromagnetic waves that have been radiated from the filament 11 are absorbed into the fine wires 12*a*. As a result, the temperature of the fine wires 12*a* also rises and the bundle 12 of fine wires 12*a*, as well as the radiator, radiates electromagnetic wave by itself. However, the bundle 12 has an array of micro-cavities extending in the axial direction of the fine wires 12*a* unlike the filament 11. That is why the bundle 12 has the function of suppressing radiations, of which the wavelengths exceed a predetermined value, in that direction. More specifically, it is from the respective ends of the fine wires 12*a* that the electromagnetic waves are radiated from the bundle 12 in that axial direction. Even so, the quantity of infrared rays radiated has been reduced and the energy can be converted into visible radiations more efficiently.

The bundle 12 consists of a plurality of fine wires 12*a* and therefore has higher electrical resistance than the filament 11. For that reason, although some of the current supplied from the stem S11 to the filament 11 flows through the gaps between the fine wires 12*a*, that current can be neglected.

The fine wires 12*a* are made of a refractory material with a melting point higher than 2,000 K. In this preferred embodiment, the respective fine wires 12*a* have a circular transversal cross section with an outside diameter of 380 nm to 2.5 μm.

Figure 5:
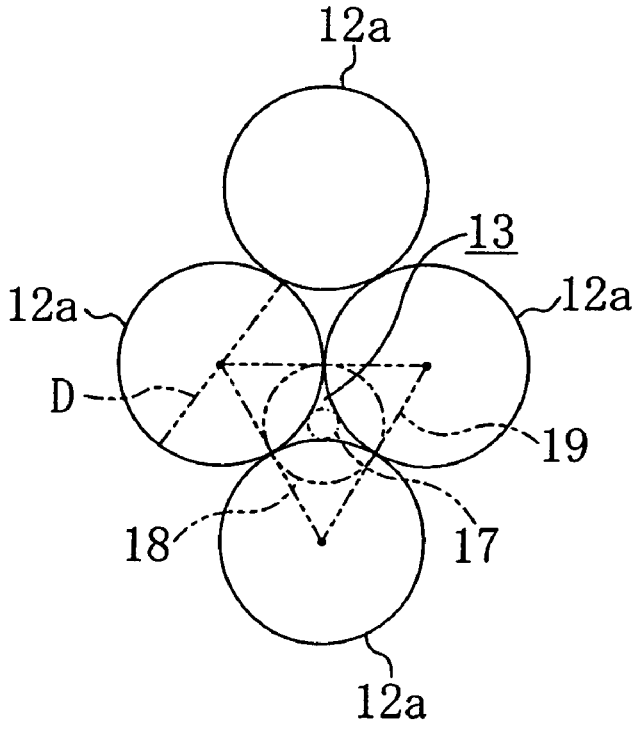
FIG. 5 is a cross-sectional view schematically showing the gaps 13 of the first preferred embodiment.

FIG. 5 shows the cross sections of arbitrarily selected four of the fine wires 12*a* in the bundle 12. As shown in FIG. 5, the adjacent fine wires 12*a* contact with each other and gaps 13 are created between the adjacent fine wires 12*a* in the transversal cross section of the bundle 12. Each of the gaps 13 is surrounded with its associated fine wires 12*a* and is electromagnetically isolated from the other gaps 13. Thus, those gaps 13 can function as micro-cavities. The gaps 13 extend in the axial direction (i.e., the length direction) of the bundle 12 to make an array of micro-cavities.

Next, the wavelengths of electromagnetic waves, of which the radiations are suppressed by the gaps 13 of the bundle 12, will be estimated.

The longest wavelength (i.e., the cutoff wavelength) of an electromagnetic wave that propagates through the gap 13 and is radiated in the axial direction of the fine wires 12*a* is defined by the transversal cross-sectional area of the gap 13. To say the least, this longest wavelength is estimated to be about twice as long as the diameter of a circle 17 that is inscribed to the gap 13 on the transversal cross section of the bundle 12. Conversely, to say the most, the longest wavelength is estimated to be about twice as long as the diameter of a circle 18 that is circumscribed to the gap 13 on the transversal cross section of the bundle 12.

The respective diameters of the inscribed and circumscribed circles 17 and 18 depend on the diameter D of each fine wire 12*a* on the transversal cross section (which will be simply referred to herein as the "diameter D of the fine wire 12*a*"). That is to say, according to geometric calculations, the inscribed circle 17 should have a diameter of 0.155D and the circumscribed circle 18 should have a diameter of 0.58D. Consequently, the magnitude of the electromagnetic wave, of which the radiation is suppressed by the gap 13 of the bundle 12, is believed to fall within the range of 0.31D to 1.16D.

Suppose all of the electromagnetic waves radiated from the filament 11 are incident on one end of the bundle 12 and the magnitude of the electromagnetic wave, of which the radiation is suppressed by the gap 13, is 800 nm or more. On this supposition, the luminous efficacy [lm/W] was calculated and it was figured out how much the luminous efficacy increased as compared to the situation where no bundles 12 were provided. The operating temperature of the filament 11 was set within a practical range of 1,600 K to 2,400 K and the ratio of the sum of the areas of the gaps 13 to the transversal cross-sectional area of the bundle 12 (i.e., the aperture ratio) was set to 9% according to geometric calculations. The results of these calculations are shown in the following Table 1:

TABLE 1

| Operating temperature (K.) | Increase (%) in efficiency | | |
|---|---|---|---|
| | Example 1 | Example 2 | Example 3 |
| 1,600 | 114.9 | 249.0 | 2,687.4 |
| 1,800 | 114.6 | 203.9 | 1,431.4 |
| 2,000 | 114.1 | 177.0 | 892.3 |
| 2,200 | 113.5 | 159.6 | 620.3 |
| 2,400 | 112.7 | 147.6 | 466.3 |

Example No. 1 shows the results of calculations in a situation where each fine wire 12*a* had a diameter D of 2 μm. Example No. 2 shows the results of calculations when each fine wire 12*a* was supposed to have a diameter D of 2 μm and no electromagnetic waves, of which the wavelengths were longer than the diameter D of the fine wires 12*a*, were radiated from the fine wires 12*a*. That is to say, the results of calculations for Example No. 2 were obtained when no electromagnetic waves having wavelengths of 2 μm or more were supposed to be radiated from the respective fine wires 12*a* of Example No. 1. Example No. 3 shows the results of calculations when each fine wire 12*a* was supposed to have a diameter D of 1 μm and no electromagnetic waves, of which the wavelengths were longer than the diameter D of the fine wires 12*a*, were radiated from the fine wires 12*a*. That is to say, the results of calculations for Example No. 3 were obtained when the fine wires 12*a* of Example No. 2 were supposed to have a diameter of 1 μm.

As can be seen from the results of Example No. 1, although the aperture ratio was 9%, an increase in efficacy of 13% to 15% could be expected when the operating temperature was 1,600 K to 2,400 K. Also, according to the results of Example No. 2, supposing each fine wire 12*a* itself had a cutoff wavelength defined by its fine wire diameter D, an increase in efficacy of 48% to 149% could be expected when the operating temperature was 1,600 K to 2,400 K. Furthermore, when each fine wire 12*a* had a diameter of 1 μm as in Example No. 3, an increase in efficacy of 366% to 2,587% could be expected when the operating temperature was 1,600 K to 2,400 K.

Consequently, by using the bundle 12 of fine wires 12*a*, an incandescent lamp with higher efficacy than a conventional one can be obtained although its aperture ratio is as small as 9%.

If the energy converter of the present invention is used as a light source, the radiator preferably has an operating temperature of at least 2,000 K. In thermal equilibrium state, the spectrum of thermal radiation depends on the temperature according to the Planck radiation formula. For example, if the temperature of a radiator increases from 1,200 K to 2,000 K, then the radiation in the visible range increases by three digits or more but the radiation in the infrared range does not change so much. That is why to produce visible radiations efficiently, the operating temperature is preferably set to be at least equal to 2,000 K. The filament 11 of this preferred embodiment is used as a radiator for an illumination source. For that reason, if the operating temperature were lower than 2,000 K, the light produced would be too reddish, which is not beneficial.

When the energy converter is used as an illumination source, the cutoff wavelength defined by the bundle of fine wires is preferably set to be at least equal to 380 nm, which is the shortest wavelength of visible radiations, and is more preferably set to be at least equal to 550 nm, at which the relative luminous efficiency is maximum for human beings. To increase the conversion efficiency of illumination sources, it is even more preferable that the cutoff wavelength is set to be 780 nm, which is the longest wavelength of visible radiations.

Among the multiple fine wires 12*a* that form the bundle 12, adjacent fine wires 12*a* are preferably in contact with each other but no fine wires 12*a* need to be fully in contact with their adjacent fine wires 12*a* in the axial direction. Some adjacent fine wires 12*a* may be out of contact with each other and the gaps 13 between them may partially communicate with each other for some manufacturing reasons. Also, as long as adjacent fine wires 12*a* make contact with each other once the lamp L1 has been turned ON, those wires 12*a* may be out of contact with each other before the incandescent lamp L1 is turned ON.

Hereinafter, an exemplary method of making the bundle 12 will be described with reference to FIGS. 6A through 6C.

Figure 6A:
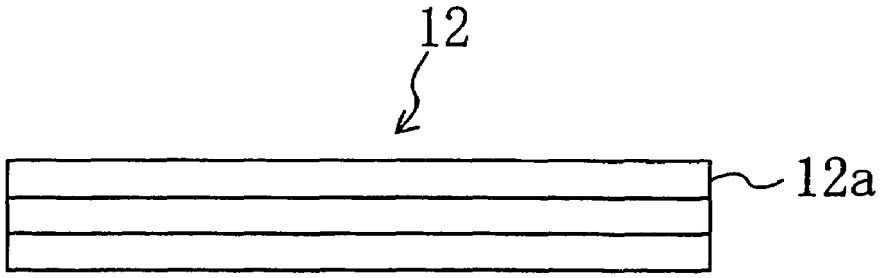
FIGS. 6A and 6B show respective process steps for making the light-emitting portion 10 of the first preferred embodiment.

First, as shown in FIG. 6A, a number of solid fine wires 12*a* of tungsten are prepared and are gathered up into the bundle 12 such that adjacent fine wires 12*a* contact with each other. The fine wires 12*a* preferably have a diameter of 380 nm to 2.5 μm, for example, and are preferably obtained by uniaxially stretching a refractory metal material such as tungsten.

Figure 6B:
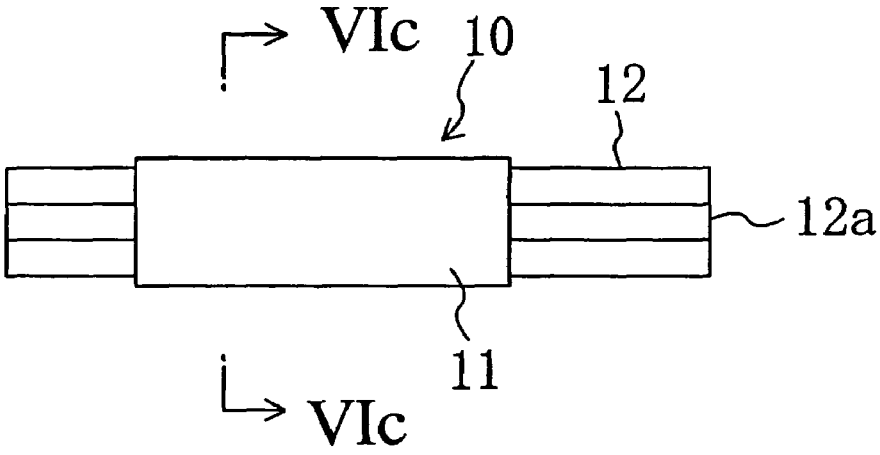
Figure 6C:
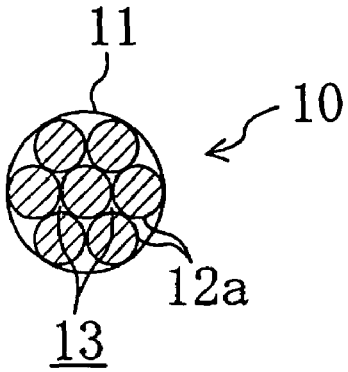
FIG. 6C is a transversal cross-sectional view of the bundle of fine wires.

Next, as shown in FIG. 6B, a cylindrical tungsten filament 11 is prepared and is loaded with the fine wires 12*a* such that the center axis of the cylindrical filament 11 is parallel to the respective axes of the fine wires 12*a*. As a result, a light-emitting portion 10, in which the cylindrical filament 11 is loaded with the fine wires 12*a* to create a plurality of gaps 13 between them, can be obtained as shown in FIG. 6C. Six fine wires 12*a* are shown in FIG. 6C. Actually, however, the number of fine wires 12*a* does not have to be six. Also, instead of preparing the cylindrical filament 11, a thin plate or ribbon-like filament 11 may be wound around the bundle 12 so as to have a cylindrical shape.

Figure 7:
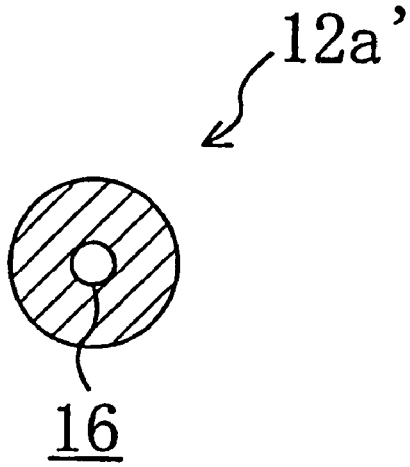
FIG. 7 shows a modified example of a fine wire according to the first preferred embodiment.

In this preferred embodiment, solid fine wires are used as the fine wires 12*a*. Alternatively, a fine wire 12*a*' with a through hole 16 may be used instead as shown in FIG. 7. If the diameter of the through hole 16 on the transversal cross section thereof is about 400 nm, which is approximately half as long as 780 nm that is the longest wavelength of visible radiations, then the through hole 16 functions similarly to the gap 13. In that case, the radiation of infrared rays from the light-emitting portion 10 would be further reduced compared with the situation where the solid fine wires 12*a* are used.

In this preferred embodiment, if the diameters D of the respective fine wires 12*a* are changed, then the magnitude of the gaps 13 will change on the transversal cross section of the bundle 12. Thus, by adjusting the diameter D of the fine wires 12*a*, the cutoff wavelength, defined by the bundle 12, can be controlled. In addition, by changing the diameters D of the respective fine wires 12*a*, the light-emitting portion 10 of this preferred embodiment can be used not only in incandescent lamps but also in infrared heaters, various types of light sources and other energy converters.

The filament 11 and respective fine wires 12*a* do not have to be made of tungsten or an alloy thereof but may also be made of molybdenum, rhenium, tantalum or an alloy thereof.

Embodiment 2

Hereinafter, a second preferred embodiment of the present invention will be described with reference to FIGS. 8 through 10.

The incandescent lamp of this preferred embodiment is made up of the same components as the incandescent lamp of the first preferred embodiment except the light-emitting portion. Thus, the following description will be focused on the structure of the light-emitting portion 20 of the second preferred embodiment and a method of making it.

Figure 8:
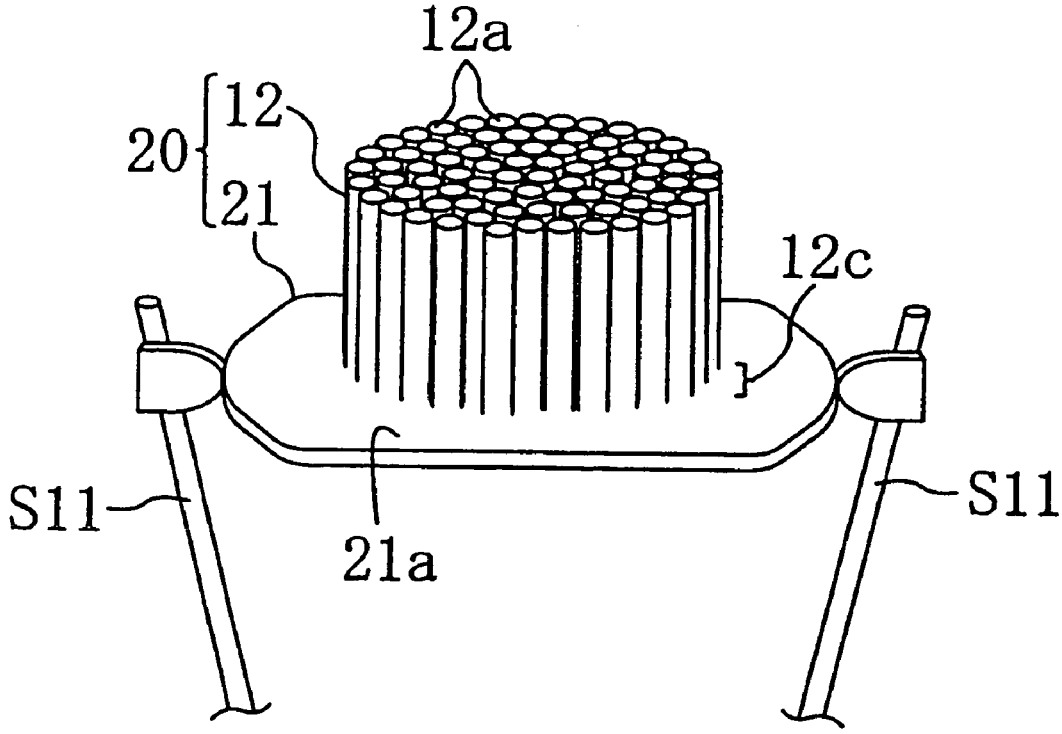
FIG. 8 is a schematic representation of a light-emitting portion 20 according to a second preferred embodiment of the present invention.

As shown in FIG. 8, the light-emitting portion 20 includes a plate-like filament 21 of tungsten and a bundle 12 of fine wires 12*a* of tungsten, and one end of the bundle 12 is melted and bonded to the radiation plane 21*a* of the filament 21.

One end of the plate-like filament 21 is connected to one end of a stem S11 and the other end of the plate-like filament 21 is connected to one end of another stem S11. The other end of each of these stems S11 is connected to a cap. The light-emitting portion 20 is supported by the pair of stems S11 in a bulb space (not shown).

Current passes one of the two stems S11 and flows through the plate-like filament 21 parallel to the radiation plane 21*a* of the filament 21 toward the other stem S11. In this manner, electrical energy is supplied to the filament 21, thereby making the filament 21 generate heat. As a result, electromagnetic waves, including visible radiations, are radiated from the radiation plane 21*a* of the filament 21.

The bundle 12 is arranged such that the respective axes of the fine wires 12*a* that form the bundle 12 are substantially perpendicular to the radiation plane 21*a*.

Hereinafter, a method of making the light-emitting portion 20 will be described with reference to FIGS. 9A through 9E.

Figure 9A:
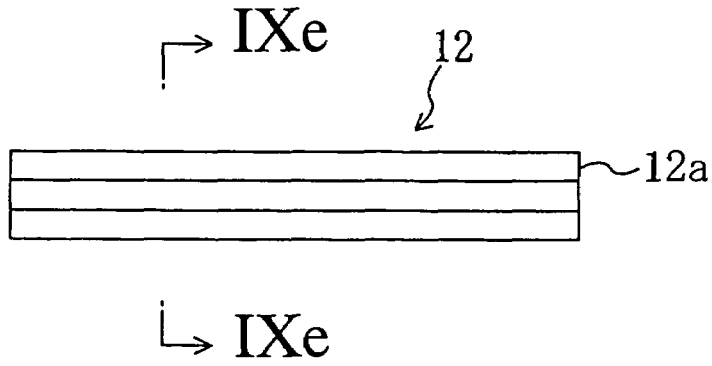
FIGS. 9A through 9D show respective process steps for making the light-emitting portion 20 of the second preferred embodiment.

First, as shown in FIG. 9A, a number of fine wires 12*a* are prepared and gathered up into a bundle 12 such that adjacent fine wires 12*a* contact with each other. As a result, several gaps 13 are created on a transversal cross section of the bundle 12 as shown in FIG. 9E.

Figure 9B:
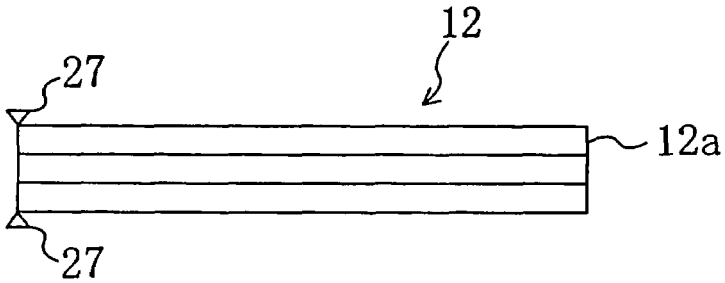
Figure 9C:
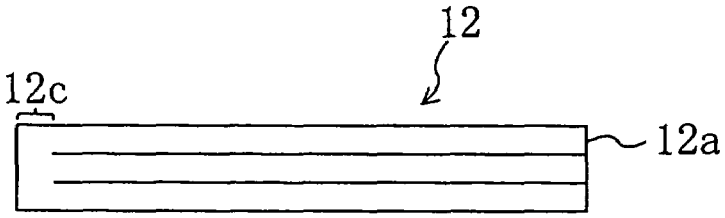

Next, as shown in FIG. 9B, one end of the bundle 12 is heated with a heating source 27 that can melt a metal such as tungsten. Then, that end of the bundle 12 will be a melted and bonded portion 12*c* as shown in FIG. 9C. As a result, the respective fine wires 12*a* are bonded together.

Figure 9D:
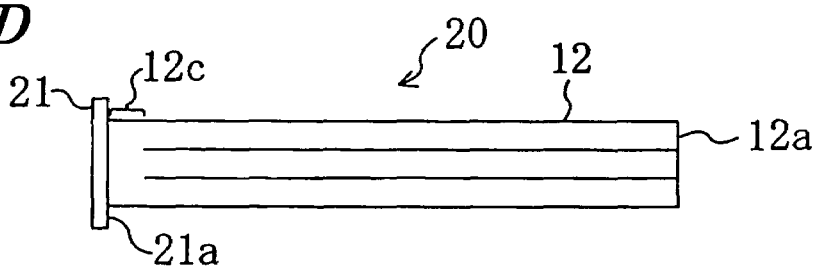
Figure 9E:
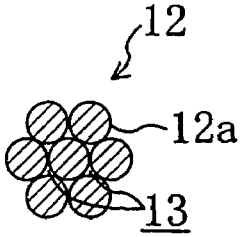
FIG. 9E is a transversal cross-sectional view of the bundle of fine wires.

Thereafter, as shown in FIG. 9D, the melted and bonded portion 12*c* and the radiation plane 21*a* of the filament 21 are brought into contact with each other and bonded together. In this manner, the light-emitting portion 20 can be obtained.

Optionally, it is possible to make the melted and bonded portion 12*c*, obtained by heating one end of the bundle 12, function as a filament by itself. In that case, there is no need to provide the filament 21 additionally.

Also, if necessary, the bundle 12 may be cut with a wire cutter or any other cutting machine at several points in the length direction, and the cut faces may be heated with the heating source 27, thereby bonding the respective fine wires 12*a* together. Conversely, after the respective fine wires 12*a* have been heated and bonded together, the fixed portions may be cut with some cutting machine. By performing such an additional cutting process, the length of the bundle 12 can be changed freely in its axial direction.

Alternatively, if the bundle 12 of fine wires is bonded and cut with a laser beam, then the bonding process step and cutting process step can be performed simultaneously. As a result, compared to the situation where the respective fine wires 12*a* are heated and bonded together, the light-emitting portion 20 can be made in a shorter time.

Hereinafter, a method of making the light-emitting portion 20 using a laser beam will be described with reference to FIG. 10.

Figure 10A:
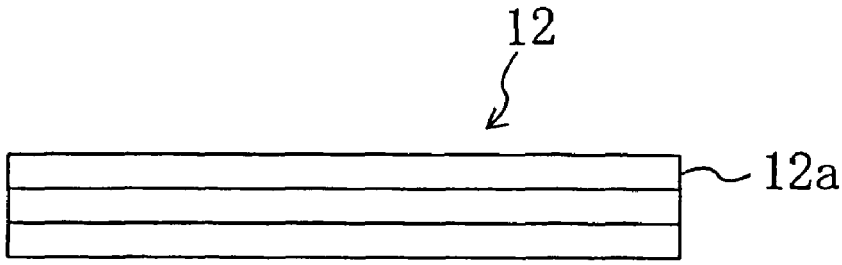
FIGS. 10A through 10D show alternative process steps for making the light-emitting portion 20 of the second preferred embodiment.
Figure 10B:
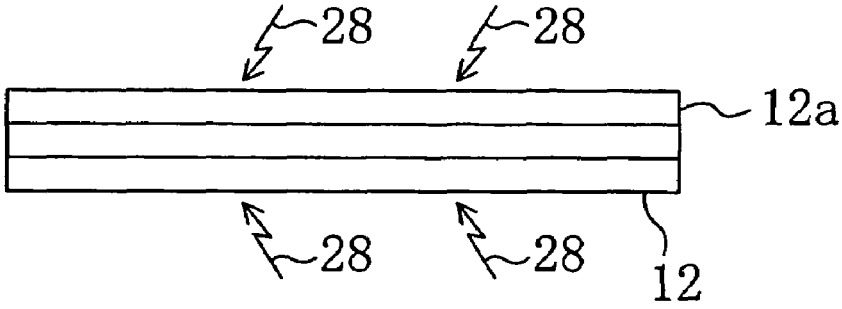
Figure 10C:
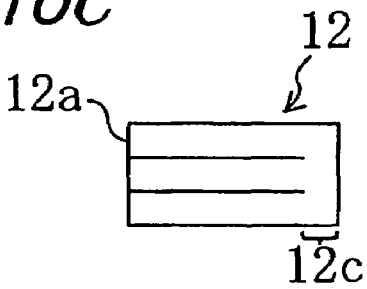
Figure 10D:
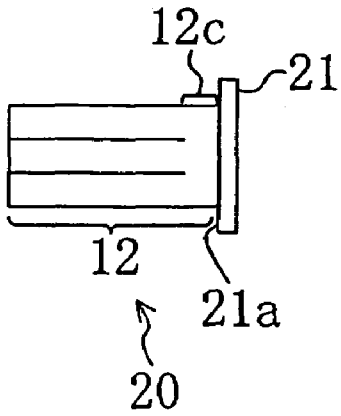

First, as shown in FIG. 10A, a number of fine wires 12*a* are prepared and gathered up into a bundle 12 such that adjacent fine wires 12*a* contact with each other. Next, as shown in FIG. 10B, the bundle 12 is irradiated with laser beams 28 in the length direction. As a result, the bundle 12 is cut into a number of pieces and the end face of each of those pieces of the bundle 12 turns into a melted and bonded portion 12*c* as shown in FIG. 10C. Consequently, the respective fine wires 12*a* are bonded together. Subsequently, as shown in FIG. 10D, the radiation plane 21*a* of the filament 21 and the melted and bonded portion 12*c* of the bundle 12 are brought into contact with each other, and bonded together. The light-emitting portion 20 may be obtained in this manner, too.

In the light-emitting portion 20, the filament 21 and the bundle 12 are in contact with each other. Consequently, the radiation efficiency of visible radiations can be increased as much as the situation where an array of micro-cavities is made on the filament 21. The function of this bundle 12 is essentially different from the filtering function of a thin film, for example, which absorbs infrared rays and passes visible radiations.

Embodiment 3

A third preferred embodiment of the present invention will be described with reference to FIG. 11.

Figure 11:
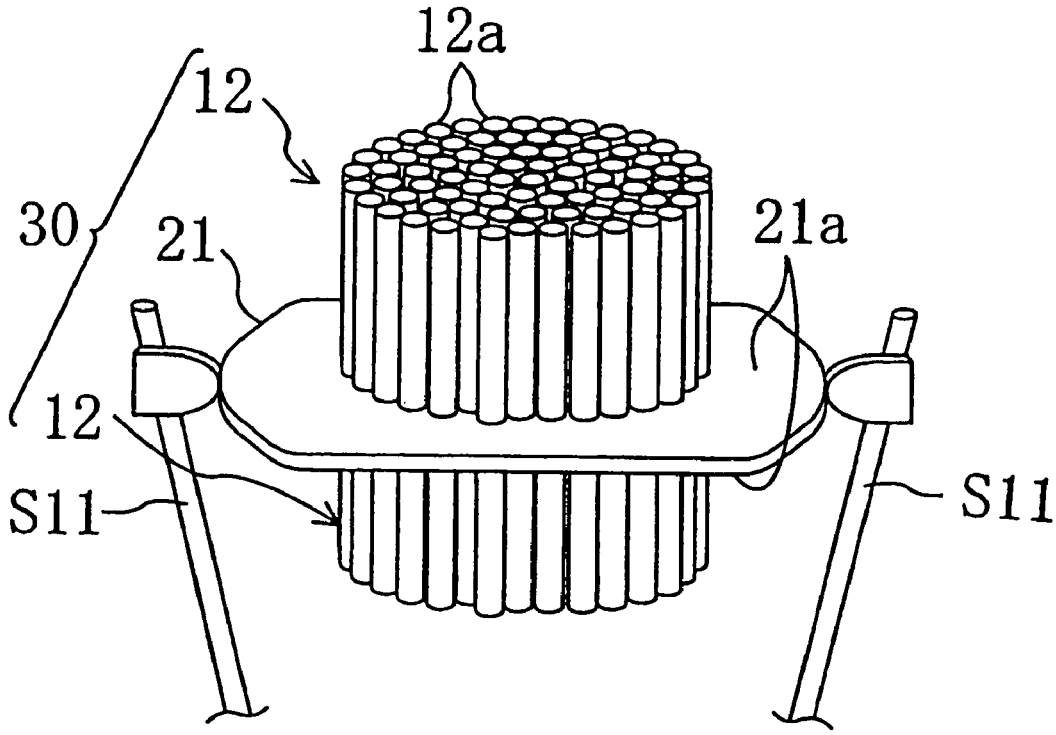
FIG. 11 is a perspective view illustrating a light-emitting portion 30 according to a third preferred embodiment of the present invention.

The incandescent lamp of this preferred embodiment includes a light-emitting portion 30 such as that shown in FIG. 11. Unlike the light-emitting portion 20 of the second preferred embodiment just described, two bundles 12 are respectively provided on the two radiation planes 21*a* of the filament 21 in the light-emitting portion 30 of this preferred embodiment. Each of these bundles 12 has one of its end faces melted and bonded to its associated radiation plane 21*a* of the filament 21. The light-emitting portion 30 may be made by substantially the same method as the light-emitting portion 20 of the second preferred embodiment.

In the light-emitting portion 30, the two bundles 12 are respectively bonded to the two radiation planes 21*a* of the filament 21. Thus, not only upward radiations of infrared rays (i.e., toward the top of the paper of FIG. 11) but also downward radiations thereof can be reduced as well.

Embodiment 4

Hereinafter, a fourth preferred embodiment of the present invention will be described with reference to FIGS. 12 and 13.

The incandescent lamp of this preferred embodiment is made up of the same components as the incandescent lamp of the first preferred embodiment except the light-emitting portion. Thus, the following description will be focused on the structure of the light-emitting portion 40 of this fourth preferred embodiment and a method of making it.

Figure 12:
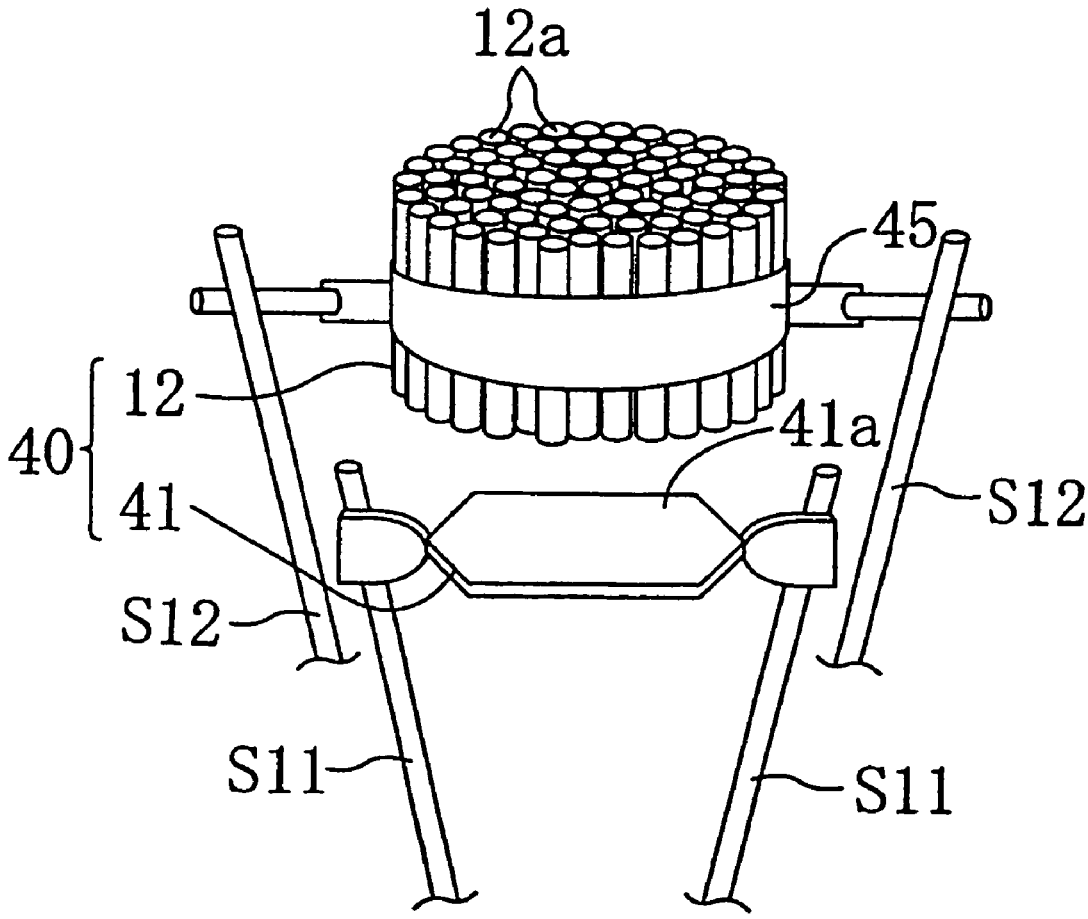
FIG. 12 is a perspective view illustrating a light-emitting portion 40 according to a fourth preferred embodiment of the present invention.

As shown in FIG. 12, the light-emitting portion 40 includes a plate-like filament 41 of tungsten and a bundle 12 of fine wires 12*a*.

One end of the plate-like filament 41 is connected to one end of a stem S11 and the other end of the plate-like filament 41 is connected to one end of another stem S11. The other end of each of these stems S11 is connected to a cap (not shown).

A cylindrical holder portion 45 is provided on the surface of the bundle 12 and is loaded with the fine wires 12*a*. Also, the holder portion 45 is connected to one end of another two stems S12. The other end of each of these additional stems S12 is connected to the base.

Current passes one of the two stems S11 and flows through the plate-like filament 41 parallel to the radiation plane 41*a* of the filament 41 toward the other stem S11. In this manner, electrical energy is supplied to the filament 41, thereby making the filament 41 generate heat. As a result, electromagnetic waves, including visible radiations, are radiated from the radiation plane 41*a* of the filament 41.

The bundle 12 is arranged such that the respective axes of the fine wires 12*a* that form the bundle 12 are substantially perpendicular to the radiation plane 41*a*. No current needs to be supplied to the stems S12 supporting the bundle 12. Optionally, the holder portion 45 may be made of a refractory metal and supplied with electrical power so as to function as a filament.

In this preferred embodiment, the bundle 12 is spaced part from the filament 41. According to this arrangement, the spacing between the radiation plane 41*a* and the bundle 12 is preferably adjusted such that the intensity of the electromagnetic waves, radiated from the filament 41, will not decrease significantly. Specifically, a space of at most 1 μm may be provided between the radiation plane 41*a* of the filament 41 and the end face of the bundle 12 that is opposed to the radiation plane 41*a*.

If the bundle 12 is not in contact with, but spaced apart from, the filament 41, then the filament 41 can operate at a higher temperature than a situation where the bundle 12 is in contact with the filament. The higher the operating temperature of the filament 41, the smaller the quantity of infrared radiations produced from the filament 41 as can be seen from Wien's displacement law. That is to say, the lamp efficiency of the light-emitting portion 40 is expected to be higher than that of any other light-emitting portion 10, 20 or 30 of the first, second or third preferred embodiment described above.

Figure 13A:
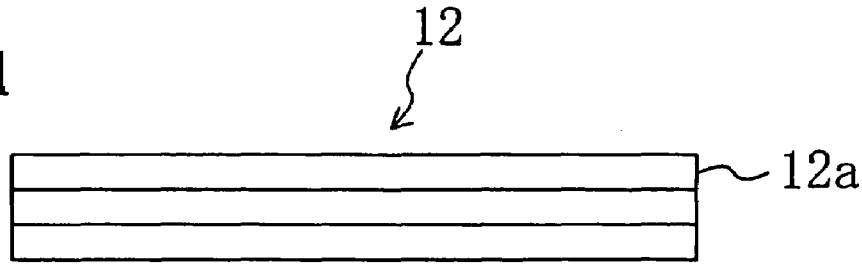
FIGS. 13A through 13C show respective process steps for making the light-emitting portion 40 of the fourth preferred embodiment.

The light-emitting portion 40 may be made in the following manner. First, as shown in FIG. 13A, a number of solid fine wires 12*a* are prepared and are gathered up into the bundle 12 such that adjacent fine wires 12*a* contact with each other.

Figure 13B:
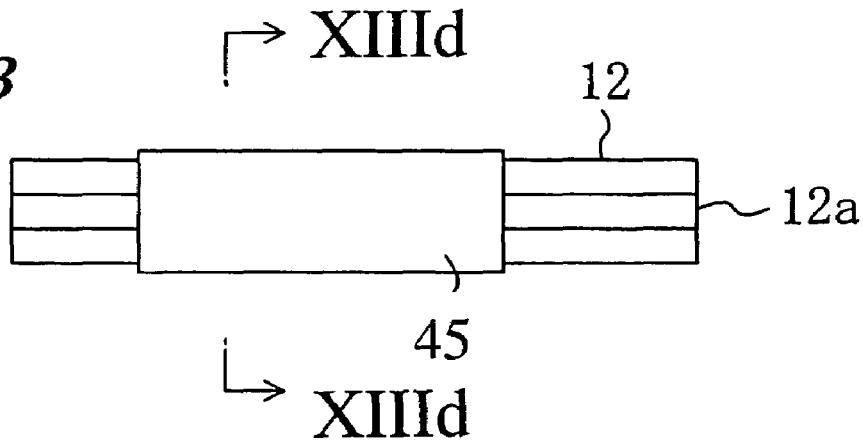

Next, as shown in FIG. 13B, a cylinder 45 is prepared and is loaded with, and fixed onto, the bundle 12 such that the center axis of the cylinder 45 is parallel to the respective axes of the fine wires 12*a*. In this manner, the fine wires 12*a* are loaded into the cylinder 45, thus creating a number of gaps 13 as shown in FIG. 13D.

Figure 13C:
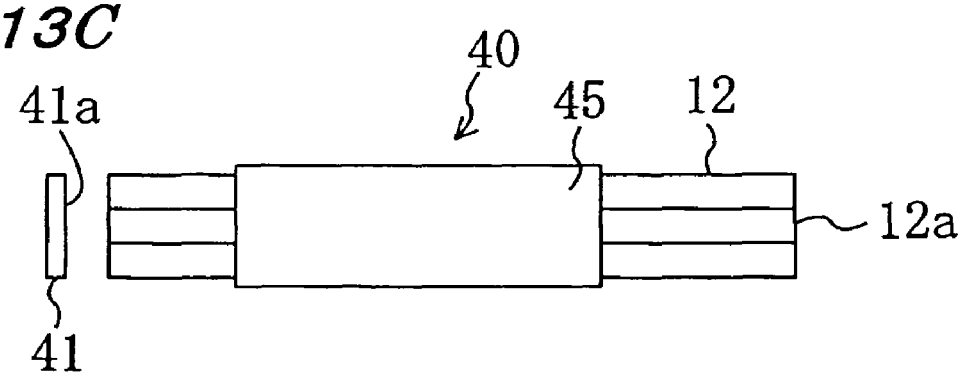
Figure 13D:
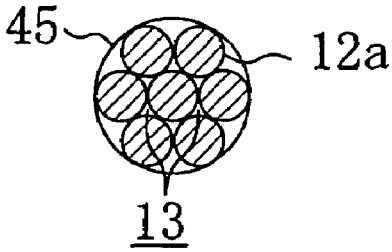
FIG. 13D is a transversal cross-sectional view of the bundle of fine wires.

Subsequently, a filament 41 is prepared and arranged such that a gap of at most 1 μm is provided between the radiation plane 41*a* of the filament 41 and one end face of the bundle 12 as shown in FIG. 13C. In this manner, the light-emitting portion 40 shown in FIG. 12 can be obtained.

In this preferred embodiment, the bundle 12 is spaced apart from the filament 41, and therefore, the filament 41 can operate at a higher temperature. As a result, the quantity of infrared radiations produced by the filament 41 can be reduced as described above. Also, since the increase in the temperature of the respective fine wires 12*a* can be checked, the fine wires 12*a* will not melt easily.

That is why even when made of a material with a lower melting point, the light-emitting portion 40 of this preferred embodiment will not lose the gaps 13 so easily as any of the other preferred embodiments described above.

In the preferred embodiment described above, the bundle 12 is fixed with the cylindrical holder portion 45. However, the holder portion 45 for fixing the bundle 12 does not have to be cylindrical but may also be a wire or a ribbon to be wound around the bundle 12 or a ringlike member.

Also, in the preferred embodiment described above, the fine wires 12*a* are fixed by inserting the bundle 12 of fine wires 12*a* into the cylinder 45 at a time while the light-emitting portion 40 is being made. Alternatively, the fine wires 12*a* may also be fixed by putting one of the fine wires 12*a* into the cylinder 45 after another such that the center axis of the cylinder 45 is parallel to the axis of each fine wire 12*a* inserted. Optionally, two bundles 12 may be arranged symmetrically over and under the filament 12, respectively.

Embodiment 5

Hereinafter, a fifth preferred embodiment of the present invention will be described with reference to FIG. 14.

Figure 14:
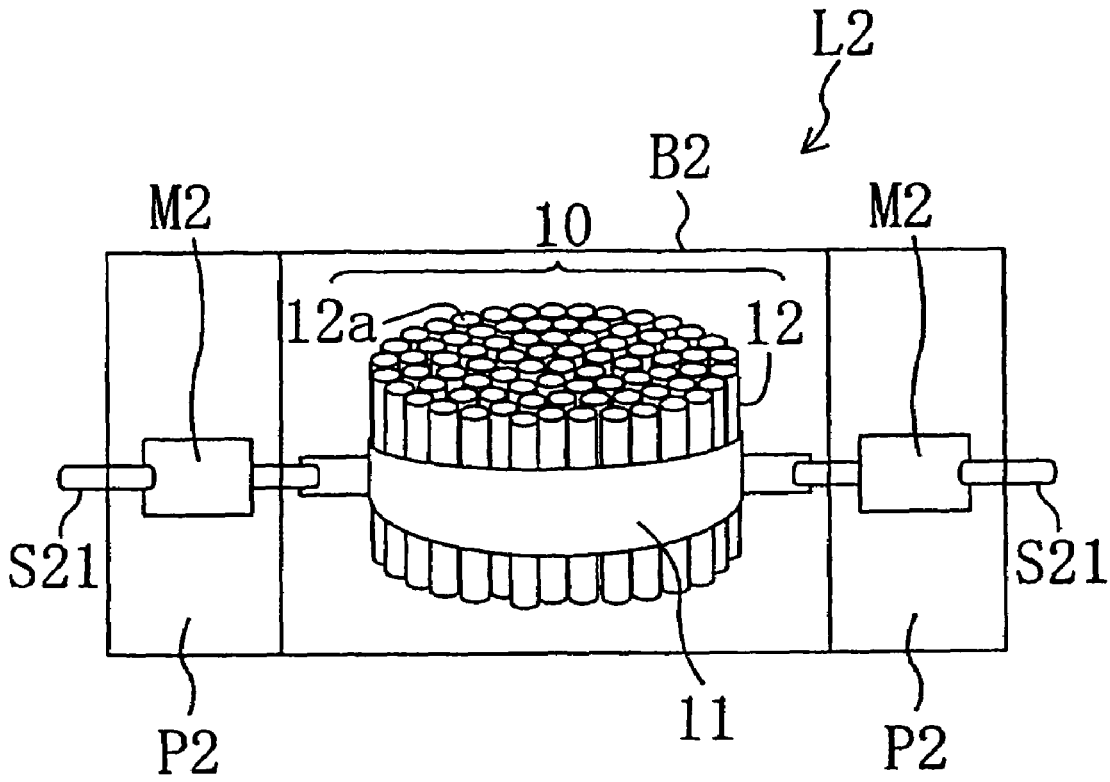
FIG. 14 is a perspective view illustrating an incandescent lamp L2 according to a fifth preferred embodiment of the present invention.

As shown in FIG. 14, the incandescent lamp L2 of this preferred embodiment includes the light-emitting portion 10, a bulb B2 that houses the light-emitting portion 10, end portions P2 that close the openings of the bulb B2, pieces of molybdenum foil M2 provided in the end portions P2 and connected to the filament 11 of the light-emitting portion 10 at one end thereof, and stems S21 connected to the other end of the respective pieces of molybdenum foil M2.

The bulb B2 has a substantially cylindrical shape. The light-emitting portion 10 is arranged such that the respective axes of the fine wires 12*a* in the light-emitting portion 10 cross the center axis of the cylinder at right angles.

As in the incandescent lamp L1 shown in FIG. 3, when current flows through the filament 11, the incandescent lamp L2 radiates electromagnetic waves including visible radiations. More specifically, current supplied from one stem S21 passes through one piece of molybdenum foil M2, flows along the side surface of the cylindrical filament 11 and then passes through the other piece of molybdenum foil M2 to reach the other stem S21.

In the example illustrated in FIG. 14, the light-emitting portion of the incandescent lamp L2 has the same structure as the light-emitting portion 10 of the first preferred embodiment described above. However, the light-emitting portion does not have to be the same as the light-emitting portion 10 but may also be the light-emitting portion 20, 30 or 40 of the second, third or fourth preferred embodiment described above.

In each of the preferred embodiments described above, the fine wires 12*a* do not have to have a circular transversal cross section but may have an elliptical or polygonal cross section as long as the gaps 13 are created when the fine wires 12*a* are gathered up into the bundle 12. Besides, the cross-sectional sizes of the respective fine wires 12*a* do not have to be equal to each other. For example, two sets of fine wires with mutually different diameters may be bundled together.

In the first preferred embodiment, the transversal cross section of the through hole 16 does not have to be circular, either, but may also be elliptical or polygonal, too.

Furthermore, the light-emitting portion does not have to have one of the shapes as described for the preferred embodiments of the present invention. For example, the bundle may be provided so as to cover the entire radiation plane of the filament. Or a single light-emitting portion may include a plurality of filaments. In that case, a bundle of fine wires may be provided for each of those multiple filaments or only one bundle of fine wires may be provided for all of those filaments.

Moreover, the shape of the bulb of the incandescent lamp is not limited to that of the bulb B1 shown in FIG. 3 or that of the bulb B2 shown in FIG. 14, either. Optionally, the inner surface of the bulb may be thinly coated with white silica powder.

In the preferred embodiments described above, an energy converter according to the present invention is applied to the light-emitting portion of an incandescent lamp. However, the energy converter of the present invention may also be used in a light source that is not intended as an illumination source. According to the present invention, the gaps in the bundle can be adjusted to any arbitrary size by changing the diameter of the fine wires, and therefore, the cutoff wavelength can be controlled to any desired value. Accordingly, the energy converter of the present invention can also arbitrarily set the wavelength of electromagnetic radiations to suppress, and is effectively applicable for use in various types of sensors and light sources for measuring instruments.

Furthermore, the energy converter of the present invention is also applicable to a system that is designed to efficiently convert thermal energy (such as solar heat), generated by some heat source, into electromagnetic waves falling within a predetermined wavelength range and then re-convert the electromagnetic waves into another energy.

An energy converter according to the present invention can be used effectively in a light source as a possible replacement for incandescent lamps that are used extensively today.

What is claimed is:

1. An energy converter comprising a radiator for converting given energy into electromagnetic waves and radiating the waves and a radiation suppressing portion for absorbing some of the electromagnetic waves which are radiated from the radiator, wherein the radiation suppressing portion has a bundle of fine metal wires, of which the axial direction is aligned with, each of the fine metal wires is in contact with its adjacent fine metal wires to form a cavity between the fine metal wires, each cavity extending in the axial direction, and the given energy is heat.

2. The energy converter of claim 1, wherein a space of 1 μm or less is provided between the radiator and the radiation suppressing portion.

3. The energy converter of claim 1, wherein the radiator receives Joule heat as the energy.

4. The energy converter of claim 3, wherein the refractory material is selected from the group consisting of tungsten, molybdenum, rhenium, tantalum, and alloys thereof.

5. The energy converter of claim 1, wherein the fine wires are made of a refractory material with a melting point higher than 2,000 K.

6. The energy converter of claim 1, wherein the fine wires are polycrystalline and have crystal grains that are aligned in the axial direction.

7. The energy converter of claim 1, wherein the radiator is made of either tungsten or an alloy thereof.

8. A light source comprising:

the energy converter according to claim 1;

a housing for shielding the energy converter from the air, at least a portion of the housing being translucent; and a terminal for supplying electrical energy to the radiator included in the energy converter, wherein the radiation suppressing portion suppresses radiations of infrared rays.

9. The light source of claim 8, wherein the fine wires have a substantially circular transversal cross section with a diameter of 400 nm to 2.5 μm.

10. The energy converter of claim 1, wherein the radiation suppressing portion is in contact with the radiator.

* * * * *

UNITED STATES PATENT AND TRADEMARK OFFICE

CERTIFICATE OF CORRECTION

PATENT NO. : 7,276,846 B2
APPLICATION NO. : 11/251944
DATED : October 2, 2007
INVENTOR(S) : Mika Sakaue et al.

It is certified that error appears in the above-identified patent and that said Letters Patent is hereby corrected as shown below:

Column 14, line 32, “claim 3” should read --claim 5--.

Signed and Sealed this

Sixth Day of May, 2008

JON W. DUDAS
*Director of the United States Patent and Trademark Office*